United States Patent [19]

Caunter

[11] 4,291,880

[45] Sep. 29, 1981

[54] SHUFFLEBOARD CUE WITH REPLACEABLE RUNNER

[75] Inventor: Earl G. Caunter, Kimbolton, Ohio

[73] Assignee: Allen R. Shuffleboard Company, Seminole, Fla.

[21] Appl. No.: 970,030

[22] Filed: Dec. 15, 1978

[51] Int. Cl.[3] ..... A63B 71/00

[52] U.S. Cl. ..... 273/129 L

[58] Field of Search ..... 273/126 R, 129 R, 129 L, 273/87.2; 403/61, 76, 91, 92, 93, 94, 95, 98, 159, 157; 15/147 A, 147 B, 147 C; 46/221

[56] References Cited

U.S. PATENT DOCUMENTS

| | | | |
|---|---|---|---|
| 2,239,391 | 4/1941 | Krause | 273/129 L |
| 2,305,562 | 12/1942 | Thompson et al. | 403/159 |
| 2,805,068 | 9/1957 | Herzer | 273/129 L |
| 3,805,302 | 4/1974 | Mathys | 403/157 |
| 4,185,827 | 1/1980 | Allen | 273/129 B |

*Primary Examiner*—Richard C. Pinkham
*Assistant Examiner*—T. Brown
*Attorney, Agent, or Firm*—Griffin, Branigan & Butler

[57] ABSTRACT

A shuffleboard cue head adapted to be coupled to a handle wherein a U-shaped frame, having laterally spaced forwardly extending arms, carries replaceable runners which snap-on in place without the need for tools or the like. A runner is mounted between a pair of cantilevered, resilient members situated at the forward end of each arm. The pair of resilient members urges a connection arrangement into engagement with the runner to pivotally attach the runner to the frame.

9 Claims, 4 Drawing Figures

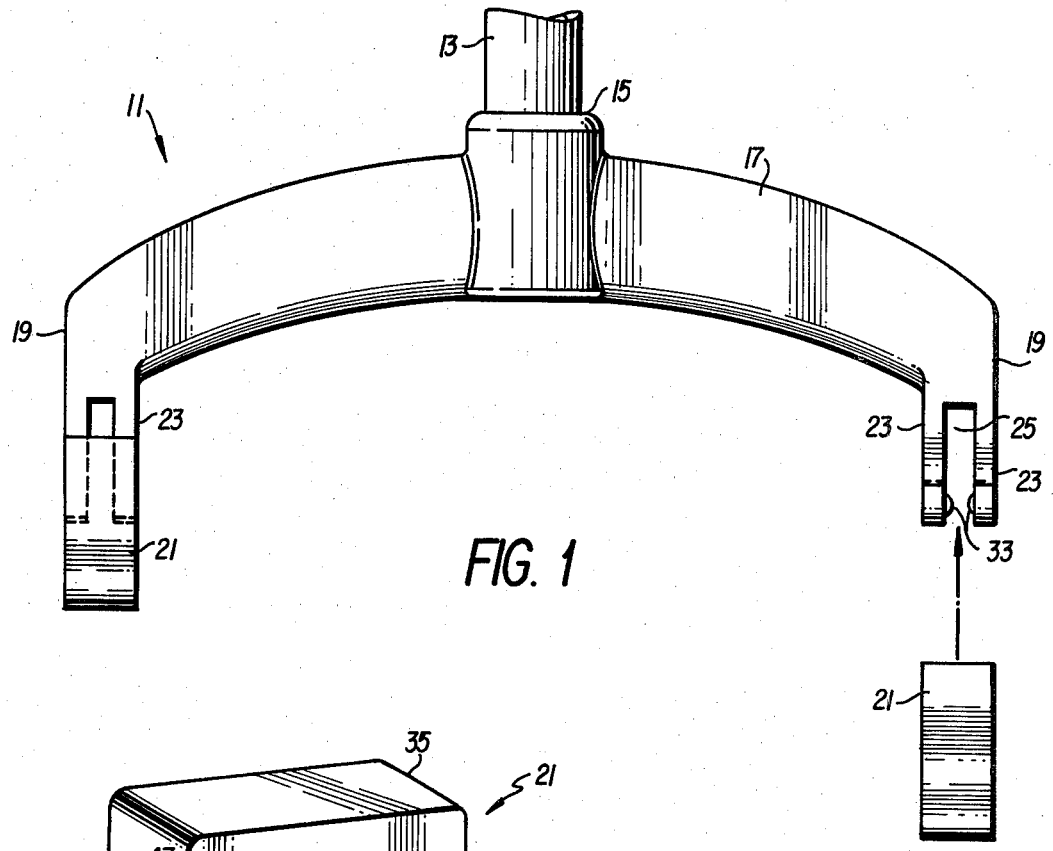
FIG. 1
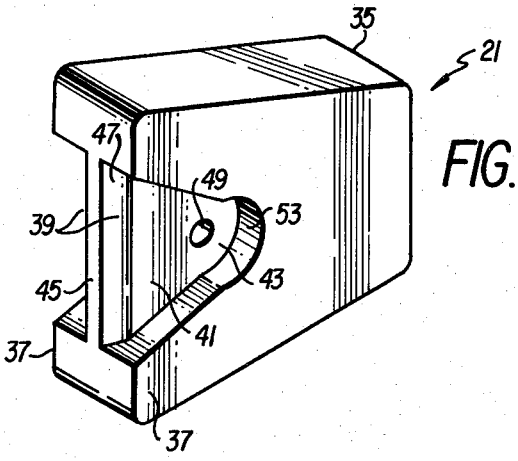
FIG. 4
FIG. 2
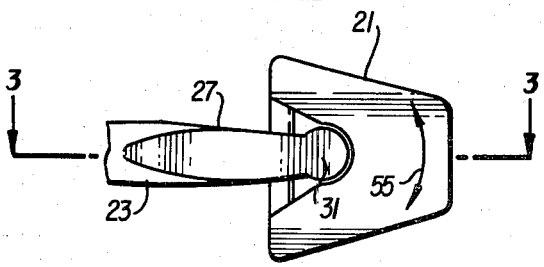
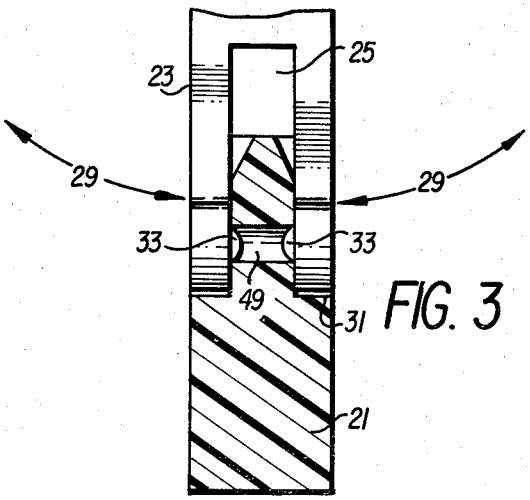
FIG. 3

SHUFFLEBOARD CUE WITH REPLACEABLE RUNNER

BACKGROUND OF THE INVENTION

This invention generally relates to a shuffleboard cue head and improvements therein and more particularly to a cue head having a snap-on arrangement for pivotally coupling replaceable runners to a frame without the need for tools or the like.

Shuffleboard is a game of skill which requires a player to accurately position a disk on a court utilizing a cue to propel the disk from one end of the court towards a scoring diagram. The accuracy of the shot depends upon the player's precise aim and ability to impart the correct amount of force to the disk to obtain the desired distance of travel. Often times, the structure and condition of the shuffleboard cue head contributes to the player's control.

In a conventional cue head a forked frame carries runners adapted to engage the peripheral edge of the disk as well as the surface of the court. During the disk propelling operation, the angular position of the entire cue with respect to the court changes which varies the amount of force imparted to the disk. Additionally, when the runners are rigidly affixed to the frame, as the angular position of the cue varies so does the angular contact of the runner with the court. This may result in an increased amount of drag as well as unwanted cue head vibration. Although prior art cue heads such as those disclosed by U.S. Pat. Nos. 2,433,496 and 2,435,855 have been mounted on rollers to eliminate much of the friction between the court and the cue head, these structures are somewhat complicated and fail to address the problems associated with runners that are rigidly affixed to the cue.

Another factor which effects the accuracy of a shot is the condition of the runners themselves. The rules of shuffleboard require that the cue head be supported on the court surface by a non-metallic element; and over an extended period of play, runners tend to wear away and in the extreme case require replacement. Although cue heads such as that disclosed in U.S. Pat. No. 2,239,391 are known having replaceable runners; the use of tools and the like are normally required.

Yet another factor which contributes to the player's accuracy involves the particular design, size and weight of the runners. A player may find himself more comfortable with a particular weight or type of runner than with others.

Many of the above noted problems are overcome by the adjustable shuffleboard cue head having swivel runners disclosed in U.S. Application Ser. No. 873,752 filed Jan. 30, 1978 by the assignee of the present invention. The adjustable cue head of the above-noted application utilizes runners which are pivotally attached by a removeable pin to a U-shaped frame. The runners are situated between a pair of laterally spaced arms having apertures through which a removeable pin pivotally attaches the runner. The pin may be retained by C-clips or similar arrangements which require the use of tools in order to accomplish removal.

SUMMARY OF THE INVENTION

It is an object of this invention to provide a shuffleboard cue having an arrangement for pivotally coupling detachable runners without the need for tools or the like.

Another object of the invention pertains to a shuffleboard cue capable of accommodating a variety of different types of runners.

A further object of this invention is to provide a shuffleboard cue which reduces cue head vibrations during a disk propelling operation.

It is yet another object of the invention to provide a shuffleboard cue structure which is inexpensive and easy to manufacture.

In accordance with the principles of the present invention, a shuffleboard cue head comprises a forked frame adapted to be mounted to a handle and having a pair of forwardly extending, laterally spaced arms which carry pivotally mounted, replaceable runners. Each runner is mounted to an arm of the frame by a snap-on arrangement comprising a pair of cantilever, resilient members having runner-engaging connection means. When the runner is positioned between a pair of resilient members, the members are parted and placed under stress thereby urging the connection means into engagement with the runner to provide a snap-on connection arrangement.

BRIEF DESCRIPTION OF THE DRAWINGS

The foregoing and other objects, features and advantages of the invention will be apparent from the following more particular description of the preferred embodiments of the invention, as illustrated in the accompanying drawings in which like characters refer to the same parts throughout different views. The drawings are not necessarily to scale, emphasis instead being placed upon illustrating the principles of the invention.

FIG. 1 is a top planar view of the present invention with a single runner removed;

FIG. 2 is a side view showing the snap-on runner in place;

FIG. 3 is a sectional view taken along line 3—3 of FIG. 2 illustrating the resilient members of the present invention; and, FIG. 4 is a perspective view of a snap-on runner of the present invention.

DESCRIPTION OF THE PREFERRED EMBODIMENTS

FIG. 1 illustrates a shuffleboard cue head 11 adapted to be attached to a shaft 13 by a suitable coupling 15. The coupling 15 may statically attach the shaft 13 to the cue head 11 or may allow the cue head 11 to pivot around the longitudinal axis of the shaft 13.

The main body or frame 17 of the cue head 11 is constructed from molded plastic although other suitable materials may be used. The frame 17 comprises a pair of laterally spaced, forwardly extending arms 19 which carry pivotally mounted, replaceable runners 21. The runners may be constructed from Delrin, wood, a polyurethane high density plastic or any suitable, wear resistant composition. In addition, the runners need not be wedge-shaped and may include a variety of geometric forms.

Each arm 19 includes a pair of cantilevered, resilient members 23 which are laterally spaced from one another to form a recess 25. As seen in FIGS. 2–3, each resilient member 23 comprises a stem portion 27, capable of limited pivotal movement along line 29, and an arcuate rim portion 31 being substantially circular. Additionally, each resilient member 23 includes a bead or small semi-hemispherical protrusion 33 formed integrally therewith and projecting into the recess 25 along an axis substantially normal to the longitudinal axis of the cue shaft 13. The bead 33 is preferably concentrically located with respect to the arcuate rim portion 31 of the resilient member 23 and provides the means for pivotally attaching the runner 21.

The replaceable, snap-on runner 21 illustrated in FIG. 4 includes a main body 35 having a suitable geometric form such as a wedge. Each side 37 of the runner 21 includes a recess or "keyhole" cut out 39 comprising a wedge-shaped portion 41 and a circular portion 43. The "keyhole" cut outs 39 leave a web 45 having a bevelled rear edge 47 and an aperture 49 which is concentrically located with regard to the circular cut out portion 43. The aperture 49 has a diameter slightly larger than the bead 33. The thickness of the web 45 should exceed the lateral distance separating each pair of beads 33, but must be less than the lateral distance between stem portions 27 to allow the runner 21 to pivot.

In order to snap-on a runner 21 to the frame 17, the bevelled edge 47 of the web 45 is positioned in the recess 25 so as to contact beads 33. As the runner 21 is slid into the recess 25 in the direction of arrow 51 as seen in FIG. 1, the beads 33 contact the web portion 45. Since the thickness of the web 45 exceeds the lateral spacing of the beads 33, the resilient members 23 are urged apart along lines 29 and placed under stress.

As the runner 21 is slid further into the recess 25, the wedge-shaped notch 41 guides the arcuate rim portion 31 of the resilient member 33 to the circular cut out portion 43. When the rim portion 31 abuts an arcuate surface 53 formed by the circular cut out portion 43, the beads 33 are aligned with the aperture 49 of the runner 21. Since the resilient members 23 are under stress, they exert a restoring force substantially normal to and towards the surface of the web 45. Therefore, the beads 33 are urged into engagement with the aperture 49 and retained in place due to the resilient nature of the members 23 to thereby pivotally couple the runner 21 to the frame 17.

During each disk propelling operation, the arcuate surface 53 cooperates with beads 33 to prevent an unintentional disengagement of the runner 21. Since the snap-on arrangement may include some play, the arcuate surface 53 prevents the arcuate rim portion 31 of the resilient member 23 from overriding the circular portion 43 of the "keyhole" cut out 39. Additionally, the wedge-shaped notch 41 determines the degree of rotational freedom afforded the runner 21 as indicated by line 55 in FIG. 2.

Removal of a runner may be accomplished merely by pulling frame 17 and the runner in opposite directions along the line 51. Removal is facilitated by slightly twisting the runner 21 about axis 51. This forces the resilient members 23 apart so that beads 33 more easily are slid out of, and disengaged from, aperture 49.

While the invention has been particularly shown and described with reference to preferred embodiments thereof, it will be understood by those skilled in the art the various changes in form and detail may be made therein without departing from the sphere and scope of the invention as defined by the appended claims. For example, the aperture 49 need not extend entirely through the web portion 45 but may instead comprise two recesses, one in each face of the web. Alternatively each resilient, cantilevered member may include an aperture in lieu of a bead; in which case, each runner would include corresponding beads adapted to engage the aperture associated with the resilient members.

I claim:

1. A shuffleboard cue head for propelling a disk along a shuffleboard court comprising:

a forked frame adapted for mounting to a handle, said frame including forwardly extending arms having first coupling means at the ends thereof for pivotally coupling detachable contact elements to the ends of said arms;

detachable contact elements mounted on said arms, said detachable contact elements including second coupling means for engaging said first coupling means of said arms to thereby pivotally mount said detachable contact elements to said arms, said first and second coupling means allowing said contact elements to be easily snapped onto and off of said arms;

one of said first and second coupling means including a pair of laterally spaced cantilevered resilient members and the other including a web for insertion between said cantilevered resilient members, one of said first and second coupling means including protrusions which engage recesses in the other of said coupling means, and one of said coupling means including a shoulder and the other including a shoulder follower for guiding the cantilevered resilient members and the web into relative positions when they are urged toward one another for bringing the protrusions and recesses into engagement;

whereby said contact elements can be quickly attached and detached to and from said arms.

2. A shuffleboard cue head as in claim 1 wherein the second coupling means includes said shoulder for guiding the shoulder follower of the first coupling means of said arms to bring said protrusions and recesses into engagement.

3. A shuffleboard cue head of claim 1 or claim 2 wherein said first coupling means includes said cantilevered resilient members and said second coupling means includes said web.

4. A shuffleboard cue head as in claim 3 wherein said first coupling means includes said protrusions and said second coupling means includes said recesses.

5. A shuffleboard cue head as in claim 4 wherein said second coupling elements are formed on said contact elements with a web portion thereof having a thickness less than a main body thereof, said main body forming said shoulder for guiding said coupling means into position for bringing said protrusions and recesses into engagement.

6. A shuffleboard cue head as in claim 3 wherein said second coupling elements are formed on said contact elements with a web portion thereof having a thickness less than a main body thereof, said main body forming said shoulder for guiding said coupling means into position for bringing said protrusions and recesses into engagement.

7. A shuffleboard cue head as in claim 1 wherein said second coupling elements are formed on said contact elements with a web portion thereof having a thickness less than a main body thereof, said main body forming said shoulder for guiding said coupling means into position for bringing said protrusions and recesses into engagement.

8. A shuffleboard cue head as in claim 1 or claim 7 wherein said shoulder defines a circular portion of said web and a substantially V-shaped portion leading into said circular portion, said protrusion/recess engagement being positioned approximately at the center of said circular portion.

9. A shuffleboard cue head as in claim 7 or claim 8 wherein said first coupling means comprises a pair of protrusions which are laterally spaced at a distance less than the width of said web.

* * * * *

UNITED STATES PATENT AND TRADEMARK OFFICE

CERTIFICATE OF CORRECTION

PATENT NO. : 4,291,880

DATED : September 29, 1981

INVENTOR(S) : Earl G. Caunter

It is certified that error appears in the above—identified patent and that said Letters Patent is hereby corrected as shown below:

Column 3, line 32, change "33" to -- 23 --.

Signed and Sealed this

*Second* Day of *March 1982*

[SEAL]

*Attest:*

GERALD J. MOSSINGHOFF

*Attesting Officer*

*Commissioner of Patents and Trademarks*